United States Patent [19]

McCollum et al.

[11] 4,005,005

[45] Jan. 25, 1977

[54] PROCESS FOR RECOVERING AND UPGRADING HYDROCARBONS FROM TAR SANDS

[75] Inventors: John D. McCollum; Leonard M. Quick, both of Naperville, Ill.

[73] Assignee: Standard Oil Company (Indiana), Chicago, Ill.

[22] Filed: Mar. 4, 1976

[21] Appl. No.: 664,015

Related U.S. Application Data

[63] Continuation of Ser. No. 474,907, May 31, 1974, abandoned.

[52] U.S. Cl. ..... 208/11 LE

[51] Int. Cl.[2] ..... C10G 1/04

[58] Field of Search ..... 208/11 LE

[56] References Cited

UNITED STATES PATENTS

| | | | |
|---|---|---|---|
| 2,665,238 | 1/1954 | Truitt et al. | 208/11 LE |
| 3,051,644 | 8/1962 | Friedman et al. | 208/11 LE |
| 3,929,193 | 12/1975 | Duke | 208/11 LE |

*Primary Examiner*—D. Horwitz
*Assistant Examiner*—James W. Hellwege
*Attorney, Agent, or Firm*—James L. Wilson; Arthur G. Gilkes; William T. McClain

[57] ABSTRACT

A process for recovering and upgrading hydrocarbons from tar sands by contacting the tar sands with a dense-water-containing fluid at a temperature in the range of from about 600° F. to about 900° F. in the absence of an externally supplied catalyst and hydrogen, and wherein the density of the water in said fluid is at least 0.10 gram per milliliter.

12 Claims, 1 Drawing Figure

PROCESS FOR RECOVERING AND UPGRADING HYDROCARBONS FROM TAR SANDS

This application is a continuation application of U.S. patent application Ser. No. 474,907, which was filed on May 31. 1974, now abandoned.

BACKGROUND OF THE INVENTION

1. Field of the Invention

This invention involves a process for recovering, cracking, desulfurizing, and demetalating hydrocarbons from tar sands.

2. Description of the Prior Art

The potential reserves of liquid hydrocarbons contained in subterranean carbonaceous deposits are known to be very substantial and form a large portion of the known energy reserves in the world. In fact, the potential reserves of liquid hydrocarbons to be derived from oil shale and tar sands greatly exceed the known reserves of liquid hydrocarbons to be derived from petroleum. As a result of the increasing demand for light hydrocarbon fractions, there is much current interest in economical methods for recovering liquid hydrocarbons from tar sands on a commercial scale. Various methods of recovery of hydrocarbons from such deposits have been proposed, but the principal difficulty with these methods is their high cost which renders the recovered hydrocarbons too expensive to compete with petroleum crudes recovered by more conventional methods.

Moreover, the value of hydrocarbons recovered from tar sands is diminished due to the presence of certain contaminants in the recovered hydrocarbons and the form of the recovered hydrocarbons. The chief contaminants are sulfurous, nitrogenous, and metallic compounds which cause detrimental effects with respect to various catalysts utilized in a multitude of processes to which the recovered hydrocarbons may be subjected. These contaminants are also undesirable because of their disagreeable odor, corrosive characteristics, and combustion products. Also the oil obtained from tar sands is heavier and more viscous than conventional petroleum crudes and has properties resembling those of residual materials. About 50 percent of the hydrocarbon fraction recovered from tar sands boils above 1000° F. and cannot be pumped in a conventional crude pipeline because of the relatively high pour point and viscosity.

Additionally, as a result of the increasing demand for light hydrocarbon fractions, there is much current interest in more efficient methods for converting the heavier hydrocarbon fractions recovered from tar sands into lighter materials. The conventional methods of converting heavier hydrocarbon fractions into lighter materials, such as catalytic cracking, coking, thermal cracking and the like, always result in the production of more highly refractory materials.

It is known that such heavier hydrocarbon fractions and such refractory materials can be converted to lighter materials by hydrocracking. Hydrocracking processes are most commonly employed on liquefied coals or heavy residual or distillate oils for the production of substantial yields of low boiling saturated products and to some extent of intermediates which are utilizable as domestic fuels, and still heavier cuts which find uses as lubricants. These destructive hydrogenation processes or hydrocracking processes may be operated on a strictly thermal basis or in the presence of a catalyst.

However, the application of the hydrocracking technique has in the past been fairly limited because of several interrelated problems. Conversion by the hydrocracking technique of heavy hydrocarbon fractions recovered from tar sands to more useful products is complicated by the presence of certain contaminants in such hydrocarbon fractions. Oils extracted from tar sands contain nitrogenous, sulfurous, and organo-metallic compounds in exceedingly large quantities. The presence of sulfur- and nitrogen-containing and organo-metallic compounds in crude oils and various refined petroleum products and hydrocarbon fractions has long been considered undesirable.

For example, because of the disagreeable odor, corrosive characteristics and combustion products (particularly sulfur dioxide) of sulfur-containing compounds, sulfur removal has been of constant concern to the petroleum refiner. Further, the heavier hydrocarbons are largely subjected to hydrocarbon conversion processes in which the conversion catalysts are, as a rule, highly susceptible to poisoning by sulfur compounds. This has led in the past to the selection of low-sulfur hydrocarbon fractions whenever possible. With the necessity of utilizing heavy, high sulfur hydrocarbon fractions in the future, economical desulfurization processes are essential. This need is further emphasized by recent and proposed legislation which seeks to limit sulfur contents of industrial, domestic, and motor fuels.

Generally, sulfur appears in feedstocks in one of the following forms: mercaptans, hydrogen sulfides, sulfides, disulfides, and as part of complex ring compounds. The mercaptans and hydrogen sulfides are more reactive and are generally found in the lower boiling fractions, for example, gasoline, naphtha, kerosene, and light gas oil fractions. There are several well-known processes for sulfur removal from such lower boiling fractions. However, sulfur removal from higher boiling fractions has been a more difficult problem. Here, sulfur is present for the most part in less reactive forms as sulfides, disulfides, and as part of complex ring compounds of which thiophene is a prototype. Such sulfur compounds are not susceptible to the conventional chemical treatments found satisfactory for the removal of mercaptans and hydrogen sulfide and are particularly difficult to remove from heavy hydrocarbon materials.

Nitrogen is undesirable because it effectively poisons various catalytic composites which may be employed in the conversion of heavy hydrocarbon fractions. In particular, nitrogen-containing compounds are effective in suppressing hydrocracking. Moreover, nitrogeneous compounds are objectionable because combustion of fuels containing these impurities possibly contributes to the release of nitrogen oxides which are noxious and corrosive and present a serious problem with respect to pollution of the atmosphere. Consequently, removal of the nitrogenous contaminants is most important and makes practical and economically attractive the treatment of contaminated stocks.

However, in order to remove the sulfur or nitrogen or to convert the heavy residue into lighter more valuable products, the heavy hydrocarbon fraction is ordinarily subjected to a hydrocatalytic treatment. This is conventionally done by contacting the hydrocarbon fraction with hydrogen at an elevated temperature and pressure and in the presence of a catalyst. Unfortunately, unlike distillate stocks which are substantially free from asphaltenes and metals, the presence of asphaltenes and metal-containing compounds in heavy hydrocarbon fraction leads to a relatively rapid reduction in the activity of the catalyst to below a practical level. The presence of these materials in the charge stock results in the deposition of metal-containing coke on the catalyst particles, which prevent the charge from coming in contact with the catalyst and thereby, in effect, reduces the catalyst activity. Eventually, the on-stream period must be interrupted, and the catalyst must be regenerated or replaced with fresh catalyst.

Particularly objectionable is the presence of iron in the form of soluble organometallic compounds. Even when the concentration of iron porphyrin complexes and other iron organometallic complexes is relatively small, that is, on the order of parts per million, their presence causes serious difficulties in the refining and utilization of heavy hydrocarbon fractions. The presence of an appreciable quantity of the organo-metallic iron compounds in feedstocks undergoing catalytic cracking causes rapid deterioration of the cracking catalysts and changes the selectivity of the cracking catalysts in the direction of more of the charge stock being converted to coke. Also, the presence of an appreciable quantity of the organo-iron compounds in feedstocks undergoing hydroconversion (such as hydrotreating or hydrocracking) causes harmful effects in the hydroconversion processes, such as deactivation of the hydroconversion catalyst and, in many instances, plugging or increasing of the pressure drop in fixed bed hydroconversion reactors due to the deposition of iron compounds in the interstices between catalyst particles in the fixed bed of catalyst.

Additionally, metallic contaminants such as nickel- and vanadium-containing compounds are found as innate contaminants in hydrocarbon fractions recovered from tar sands. When the hydrocarbon fractions are topped to remove the light fractions boiling above about 450°–650° F., the metals are concentrated in the residual bottoms. If the residuum is then further treated, such metals adversely affect catalysts. When the hydrocarbon fraction is used as a fuel, the metals also cause poor performance in industrial furnaces by corroding the metal surfaces of the furnace.

A promising technique for recovering liquid hydrocarbons from tar sands is a process called dense fluid extraction. Separation by dense fluid extraction at elevated temperatures is a relatively unexplored area. The basic principles of dense fluid extraction at elevated temperatures are outlined in the monograph "The Principles of Gas Extraction" by P. F. M. Paul and W. S. Wise, published by Mills and Boon Limited in London, 1971, of which Chapters 1 through 4 are specifically incorporated herein by reference. The dense fluid can be either a liquid or a dense gas having a liquid-like density.

Dense fluid extraction depends on the changes in the properties of a fluid — in particular, the density of the fluid — due to changes in the pressure. At temperatures below its critical temperature, the density of a fluid varies in step functional fashion with changes in the pressure. Such sharp transitions in the density are associated with vapor-liquid transitions. At temperatures above the critical temperature of a fluid, the density of the fluid increases almost linearly with pressure as required by the Ideal Gas Law, although deviations from linearity are noticeable at higher pressures. Such deviations are more marked as the temperature of the fluid is nearer, but still above, its critical temperature.

If a fluid is maintained at a temperature below its critical temperature and at its saturated vapor pressure, two phases will be in equilibrium with each other, liquid X of density C and vapor Y of density D. The liquid of density C will possess a certain solvent power. If the same fluid were then maintained at a particular temperature above its critical temperature and if it were compressed to density C, then the compressed fluid could be expected to possess a solvent power similar to that of liquid X of density C. A similar solvent power could be achieved at an even higher temperature by an even greater compression of the fluid to density C. However, because of the non-ideal behavior of the fluid near its critical temperature, a particular increase in pressure will be more effective in increasing the density of the fluid when the temperature is slightly above the critical temperature than when the temperature is much above the critical temperature of the fluid.

These simple considerations lead to the suggestion that a given pressure and at a temperature above the critical temperature of a compressed fluid, the solvent power of the compressed fluid should be greater the lower the temperature; and that, at a given temperature above the critical temperature of the compressed fluid, the solvent power of the compressed fluid should be greater the higher the pressure.

Although such useful solvent effects have been found above the critical temperature of the fluid solvent, it is not essential that the solvent phase be maintained above its critical temperature. It is only essential that the fluid solvent be maintained at high enough pressures so that its density is high. Thus, liquid fluids and gaseous fluids which are maintained at high pressures and have liquid-like densities are useful solvents in dense fluid extractions at elevated temperatures.

The basis of separations by dense fluid extraction at elevated temperatures is that a substrate is brought into contact with a dense, compressed fluid at an elevated temperature, material from the substrate is dissolved in the fluid phase, then the fluid phase containing this dissolved material is isolated, and finally the isolated fluid phase is decompressed to a point where the solvent power of the fluid is destroyed and where the dissolved material is separated as a solid or liquid.

Some general conclusions based on empirical correlations have been drawn regarding the conditions for achieving high solubility of substrates in dense, compressed fluids. For example, the solvent effect of a dense, compressed fluid depends on the physical properties of the fluid solvent and of substrate. This suggests that fluids of different chemical nature but similar physical properties would behave similarly as solvents. An example is the discovery that the solvent power of compressed ethylene and carbon dioxide is similar.

In addition, it has been concluded that a more efficient dense fluid extraction should be obtained with a solvent whose critical temperature is nearer the extraction temperature than with a solvent whose critical temperature is farther from the extraction temperature. Further since the solvent power of the dense, compressed fluid should be greater the lower the temperature but since the vapor pressure of the material to be extracted should be greater the higher the temperature, the choice of extraction temperature should be a compromise between these opposing effects.

Various ways of making practical use of dense fluid extraction are possible following the analogy of conventional separation processes. For example, both the extraction stage and the decompression stage afford considerable scope for making separations of mixtures of materials. Mild conditions can be used to extract first the more volatile materials, and then more severe conditions can be used to extract the less volatile materials. The decompression stage can also be carried out in a single stage or in several stages so that the less volatile dissolved species separate first. The extent of extraction and the recovery of product on decompression can be controlled by selecting an appropriate fluid solvent, by adjusting the temperature and pressure of the extraction or decompression, and by altering the ratio of substrate-to-fluid solvent which is charged to the extraction vessel.

In general, dense fluid extraction at elevated temperatures can be considered as an alternative, on the one hand, to distillation and, on the other hand, to extraction with liquid solvents at lower temperatures. A considerable advantage of dense fluid extraction over distillation is that it enables substrates of low volatility to be processed. Dense fluid extraction even offers an alternative to molecular distillation, but with such high concentrations in the dense fluid phase that a marked advantage in throughput should result. Dense fluid extraction would be of particular use where heat-liable substrates have to be processed since extraction into the dense fluid phase can be effected at temperatures well below those required by distillation.

A considerable advantage of dense fluid extraction at elevated temperatures over liquid extraction at lower temperatures is that the solvent power of the compressed fluid solvent can be continuously controlled by adjusting the pressure instead of the temperature. Having available a means of controlling solvent power by pressure changes gives a new approach and scope to solvent extraction processes.

Zhuze was apparently the first to apply dense fluid extraction to chemical engineering operations in a scheme for de-asphalting petroleum fractions using a propane-propylene mixture as gas, as reported in Vestnik Akad. Nauk S.S.S.R. 29 (11), 47–52 (1959); and in Petroleum (London) 23, 298–300 (1960).

Apart from Zhuze's work, there have been few detailed reports of attempts to apply dense fluid extraction techniques to substrates of commercial interest. British Patent No. 1,057,911 (1964) describes the principles of gas extraction in general terms, emphasizes its use as a separation technique complementary to solvent extraction and distillation, and outlines multistage operation. British Patent No. 1,111,422 (1965) refers to the use of gas extraction techniques for working up heavy petroleum fractions. A feature of particular interest is the separation of materials into residue and extract products, the latter being free from objectionable inorganic contaminants such as vanadium. The advantage is also mentioned in this patent of cooling the gas solvent at subcritical temperatures before recycling it. This converts it to the liquid form which requires less energy to pump it against the hydrostatic head in the reactor than would a gas. French patents 1,512,060 (1967) and 1,512,061 (1967) mention the use of gas extraction on petroleum fractions. In principle, these seem to follow the direction of the earlier Russian work.

In addition, there are other references to recovery of liquid hydrocarbon fractions from carbonaceous materials by processes utilizing water. For example, Friedman et al., U.S. Pat. No. 3,051,644 (1962) discloses a process for the recovery of oil from oil shale which involves subjecting oil shale particles dispersed in steam to treatment with steam at a temperature in the range of from 700° F. to 900° F. and at a pressure in the range of from 1000 to 3000 pounds per square inch gauge. Oil from the oil shale is withdrawn in vapor form admixed with steam.

Truitt et al., U.S. Pat. No. 2,655,238 (1954) discloses a method of recovering oil from oil shale which involves treating the shale with water in a large amount approximating the weight of the shale, at a temperature in excess of 500° F. and under a pressure in excess of 1000 pounds per square inch. The amount of oil recovered increases generally as the temperature or pressure is further increased, but pressures as high as about 3000 pounds per square inch gauge and temperatures at least approximately as high as 700° F. are required to effect a substantially complete recovery of the oil.

There have been numerous references to processes for cracking, desulfurizing, denitrifying, demetalating, and generally upgrading hydrocarbon fractions by processes involving water. For example, Gatsis, U.S. Pat. No. 3,453,206 (1969) discloses a multi-stage process for hydrorefining heavy hydrocarbon fractions for the purpose of eliminating and/or reducing the concentration of sulfurous, nitrogeneous, organo-metallic, and asphaltenic contaminants therefrom. The nitrogenous and sulfurous contaminants are converted to ammonia and hydrogen sulfide. The stages comprise pretreating the hydrocarbon fraction in the absence of a catalyst, with a mixture of water and externally supplied hydrogen at a temperature above the critical temperature of water and a pressure of at least 1000 pounds per square inch gauge and then reacting the liquid product from the pretreatment stage with externally supplied hydrogen at hydrorefining conditions and in the presence of a catalytic composite. The catalytic composite comprises a metallic component composited with a refractory inorganic oxide carrier material of either synthetic or natural origin, which carrier material has a medium-to-high surface area and a well-developed pore structure. The metallic component can be vanadium, niobium, tantalum, molybdenum, tungsten, chromium, iron, cobalt, nickel, platinum, palladium, iridium, osmium rhodium, ruthenium, and mixtures thereof.

Gatsis, U.S. Pat. No. 3,501,396 (1970) discloses a process for desulfurizing and denitrifying oil which comprises mixing the oil with water at a temperature above the critical temperature of water up to about 800° F. and at a pressure in the range of from about 1000 to about 2500 pounds per square inch gauge and reacting the resulting mixture with externally supplied hydrogen in contact with a catalytic composite. The catalytic composite can be characterized as a dual function catalyst comprising a metallic component such as iridium, osmium, rhodium, ruthenium and mixtures thereof and an acidic carrier component having cracking activity. An essential feature of this method is the catalyst being acidic in nature. Ammonia and hydrogen sulfide are produced in the conversion of nitrogenous and sulfurous compounds, respectively.

Pritchford et al., U.S. Pat. No. 3,586,621 (1971) discloses a method for converting heavy hydrocarbon oils, residual hydrocarbon fractions, and solid carbonaceous materials to more useful gaseous and liquid products by contacting the material to be converted with a nickel spinel catalyst promoted with a barium salt of an organic acid in the presence of steam. A temperature in the range of from 600° F. to about 1000° F. and a pressure in the range of from 200 to 3000 pounds per square inch gauge are employed.

Pritchford, U.S. Pat. No. 3,676,331 (1972) discloses a method for upgrading hydrocarbons and thereby producing materials of low molecular weight and of reduced sulfur content and carbon residue by introducing water and a catalyst system containing at least two components into the hydrocarbon fraction. The water can be the natural water content of the hydrocarbon fraction or can be added to the hydrocarbon fraction from an external source. The water-to-hydrocarbon fraction volume ratio is preferably in the range from about 0.1 to about 5. At least the first of the components of the catalyst system promotes the generation of hydrogen by reaction of water in the water gas shift reaction and at least the second of the components of the catalyst system promotes reaction between the hydrogen generated and the constituents of the hydrocarbon fraction. Suitable materials for use as the first component of the catalyst system are the carboxylic acid salts of barium, calcium, strontium, and magnesium. Suitable materials for use as the second component of the catalyst system are the carboxylic acid salts of nickel, cobalt, and iron. The process is carried out at a reaction temperature in the range of from about 750° F. to about 850° F. and at a pressure of from about 300 to about 4000 pounds per square inch gauge in order to maintain a principal portion of the crude oil in the liquid state.

Wilson et al., U.S. Pat. No. 3,733,259 (1973) discloses a process for removing metals, asphaltenes, and sulfur from a heavy hydrocarbon oil. The process comprises dispersing the oil with water, maintaining this dispersion at a temperature between 750° F. and 850° F. and at a pressure between atmospheric and 100 pounds per square inch gauge, cooling the dispersion after at least one-half hour to form a stable water-asphaltene emuslion, separating the emulsion from the treated oil, adding hydrogen, and contacting the resulting treated oil with a hydrogenation catalyst at a temperature between 500° F. and 900° F. and at a pressure between about 300 and 3000 pounds per square inch gauge.

It has also been announced that the semi-governmental Japan Atomic Energy Research Institute, working with the Chisso Engineering Corporation, has developed what is called a "simple, low-cost, hot-water, oil desulfurization process" said to have "sufficient commercial applicability to compete with the hydrogenation process." The process itself consists of passing oil through a pressurized boiling water tank in which water is heated up to approximately 250° C., under a pressure of about 100 atmospheres. Sulfides in oil are then separated when the water temperature is reduced to less than 100° C.

Thus far, no one has disclosed the method of this invention for recovering and upgrading hydrocarbon fractions from tar sands, which permits operation at lower than conventional temperatures, without an external source of hydrogen, and without preparation or pretreatment, such as, desalting or demetalation, prior to upgrading the recovered hydrocarbon fraction.

SUMMARY OF THE INVENTION

This invention is a process for recovering hydrocarbons from tar sands solids and simultaneously for cracking, desulfurizing, and demetalating the recovered hydrocarbons, which comprises contacting the tar sands solids with a water-containing fluid at a temperature in the range of from about 600° F. to about 900° F. in the absence of an externally supplied catalyst and hydrogen. The density of water in the water-containing fluid is at least 0.10 gram per milliliter, and sufficient water is present to serve as an effective solvent for the recovered hydrocarbons. Preferably, essentially all the sulfur removed from the recovered hydrocarbons is in the form of elemental sulfur.

The density of water in the water-containing fluid is preferably at least 0.5 gram per milliliter and most preferably at least 0.2 gram per milliliter. The temperature is preferably at least 705° F., the critical temperature of water. The tar sands solids and water-containing fluid are contacted preferably for a period of time in the range of from about 1 minute to about 6 hours, more preferably in the range of from about 5 minutes to about 3 hours and most preferably in the range of from about 10 minutes to about 1 hour. The weight ratio of the tar sands solids-to-water in the water containing fluid is preferably in the range of from about 3:2 to about 1:10 and more preferably in the range of from about 1:1 to about 1:3. The water-containing fluid is preferably substantially water and more preferably water.

DETAILED DESCRIPTION

Figure 1:
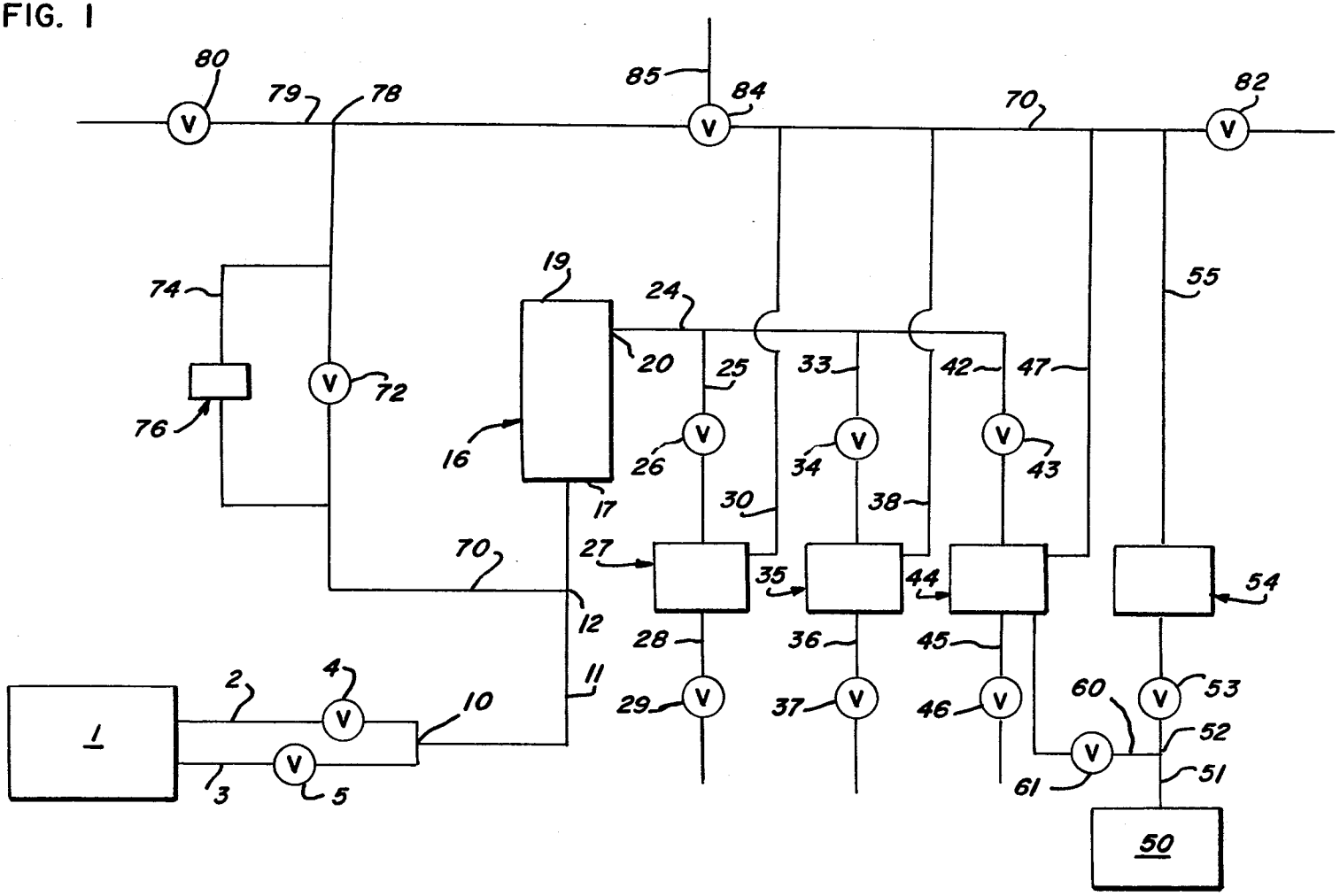
FIG. 1 is a schematic diagram of the flow system used for semicontinuously processing a hydrocarbon fraction.

It has been found that hydrocarbons can be recovered from tar sands solids and that the recovered hydrocarbons can be upgraded, cracked, desulfurized, and, demetalated by contacting the tar sands solids with a dense-water-containing phase, either gas or liquid, at a reaction temperature in the range of from about 600° F. to about 900° F. and in the absence of an externally supplied catalyst and hydrogen.

We have found that, in order to effect the recovery of hydrocarbons from tar sands and in order to effect the chemical conversion of the recovered hydrocarbons into lighter, more useful hydrocarbon fractions by the method of this invention — which involves processes characteristically occuring in solution rather than typical pyrolytic processes — the water in the dense-water-containing fluid phase must have a high solvent power and liquid-like densities — for example, at least 0.1 gram per milliliter — rather than vapor-like densities. Maintenance of the water in the dense-water-containing phase at a relatively high density, whether at temperatures below or above the critical temperature of water, is essential to the method of this invention. The density of the water in the dense-water-containing phase must be at least 0.1 gram per milliliter.

The high solvent power of dense fluids is discussed in the monograph "The Principles of Gas Extraction" by P. F. M. Paul and W. S. Wise, published by Mills and Boon Limited in London, 1971. For example, the difference in the solvent power of steam and of dense gaseous water maintained at a temperature in the region of the critical temperature of water and at an elevated pressure is substantial. Even normally insoluble inorganic materials, such as silica and alumina, commence to dissolve appreciably in "supercritical water" — that is, water maintained at a temperature above the critical temperature of water — so long as a high water density is maintained.

Enough water must be employed so that there is sufficient water in the dense-water-containing phase to serve as an effective solvent for the recovered hydrocarbons. The water in the dense-water-containing phase can be in the form either of liquid water or of dense gaseous water. The vapor pressure of water in the dense-water-containing phase must be maintained at a sufficiently high level so that the density of water in the dense-water-containing phase is at least 0.1 gram per milliliter.

We have found that, with the limitations imposed by the size of the reaction vessels we employed in this work, a weight ratio of the tar sands solids-to-water in the dense-water-containing phase in the range of from about 3:2 to about 1:10 is preferable and a ratio in the range of from about 1:1 to about 1:3 is more preferable.

A particularly useful water-containing fluid contains water in combination with an organic compound such as biphenyl, pyridine, a partly hydrogenated aromatic oil, or a mono- or polyhydric compound such as methyl alcohol. The use of such combinations extends the limits of solubility and rates of dissolution so that cracking, desulfurization, and demetalation can occur even more readily. Furthermore, the component other than water in the dense-water-containing phase can serve as a source of hydrogen, for example, by reaction with water.

This process can be performed either as a batch process or as a continuous or semi-continuous flow process. Contact times between the tar sands solids and the dense-water-containing phase — that is, residence time in a batch process or inverse solvent space velocity in a flow process - of from the order of minutes up to about 6 hours are satisfactory for effective cracking, desulfurization, and demetalation of the recovered hydrocarbons.

In the method of this invention, the water-containing fluid and the tar sands solids are contacted by making a slurry of the tar sands solids in the water-containing fluid. When the method of this invention is performed above ground with mined tar sands, the hydrocarbons can be recovered more rapidly if the mined solids are ground to a particle size preferably of ½-inch diameter or smaller. Alternately, the method of this invention could also be performed in situ in subterranean deposits by pumping the water-containing fluid into the deposit and withdrawing hydrocarbon products for separation or further processing.

Example 1 involves batch processing of a tar sands feed and illustrates that hydrocarbons are recovered, cracked, desulfurized, and demetalated in the method of this invention. The tar sands feed and water were loaded at ambient temperature into a 300-milliliter Hastelloy alloy C Magne-Drive batch autoclave in which the reaction mixture was to be mixed. Sufficient water was added so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660° F. Approximately 6 minutes were required to raise the temperature from 660° F. to 700° F. Approximately another 6 minutes were required to raise the temperature from 700° F. to 750° F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized and was flash-distilled from the reaction vessel, removing the gas, water, and "oil", and leaving the "bitumen" and inorganic residue in the reaction vessel. The oil was the liquid hydrocarbon fraction boiling at or below the reaction temperature and the bitumen was the hydrocarbon fraction boiling above the reaction temperature. The inorganic residue was spent tar sands.

The gas, water, and oil were trapped in a pressure vessel cooled by liquid nitrogen. The gas was removed by warming the pressure vessel to room temperature and then was analyzed by mass spectroscopy, gas chromatography, and infra-red. The water and oil were then purged from the pressure vessel by means of compressed gas and occasionally also by heating the vessel. Then the water and oil were separated by decantation. The oil was analyzed for its sulfur and nitrogen content using x-ray fluorescence and the Kjeldahl method, respectively, and for its density and API gravity.

The bitumen and inorganic residue were washed from the reaction vessel with chloroform, and the bitumen dissolved in this solvent. The solid residue was then separated from the solution containing the bitumen by filtration. The bitumen was analyzed for its sulfur and nitrogen contents using the same methods as in the analysis of the oil. The solid residue was analyzed for its inorganic carbonate content.

Example 1 involves a batch recovery of hydrocarbons from raw tar sands using the method of this invention. The conditions employed were a reaction temperature of 725° F., a reaction time of 2 hours, a reaction pressure of 4100 pounds per square inch gauge, and an argon pressure of 250 pounds per square inch gauge. The feed was made up of 40 grams of raw tar sands in 90 grams of water. This run was performed in a 300-milliliter Hastelloy alloy C Magne-Drive autoclave. The products of this extraction included gas (hydrogen, carbon dioxide, and methane) and oil in amounts equivalent to 2 and 8 weight percent of the feed, respectively. The oil had an API gravity of about 17.0 and sulfur, nickel, and vanadium contents of 2.7 weight percent, and 45 and 30 parts per million, respectively. On the contrary, tar sands oil obtained by the COFCAW process had an API gravity of 12.2 and sulfur, nickel, and vanadium contents of 4.6 weight percent, and 74 and 182 parts per million, respectively. Hence, the oil obtained by the method of this invention is upgraded relative to the oil produced by the COFCAW process.

Further, the yields of gas, oil, bitumen, and solid products in this Example were 2.5, 3.7, 3.4, and 86.5 weight percent of the tar sands feed. This represents essentially complete recovery of the hydrocarbon content of the tar sands feed. The total amount of gas, oil, bitumen, and solid fractions and of water recovered constituted 97.4 weight percent of the tar sands and water feeds.

Examples 2–13 involve batch processing of different types of hydrocarbon feedstocks under the condition employed in the method of this invention and illustrate that the method of this invention effectively cracks, desulfurizes, and demetalates hydrocarbons and therefore that the hydrocarbons recovered from the tar sands are also cracked, desulfurized, and demetalated in the method of this invention. Unless otherwise specified, the following procedure was used in each case. The hydrocabon feed and water were loaded at ambient temperature into a 300-milliliter Hastelloy alloy C Magne-Drive or 300-milliliter Hastelloy alloy B Magne-Dash batch reactor in which the reaction mixture was to be mixed. Unless otherwise specified, sufficient water was added in each Example so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660° F. Approximately 6 minutes were required to raise the temperature from 660° F. to 700° F. Approximately another 6 minutes were required to raise the temperature from 700° F. to 750° F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized and was flash-distilled from the reaction vessel, removing the gas, water, and "light" ends, and leaving the "heavy" ends and other solids in the reaction vessel. The light ends were the hydrocarbon fraction boiling at or below the reaction temperature and the heavy ends were the hydrocarbon fraction boiling above the reaction temperature. The gas, water, and light ends were trapped in a pressure vessel cooled by liquid nitrogen. The gas was removed by warming the pressure vessel to room temperature and then was analyzed by mass spectroscopy, gas chromatography, and infra-red. The water and light ends were then purged from the pressure vessel by means of compressed gas and occasionally also by heating the vessel. Then the water and light ends were separated by decantation. Alternately, this separation was postponed until a later stage in the procedure. Gas chromatograms were run on the light ends.

The heavy ends and solids were washed from the reaction vessel with chloroform, and the heavy ends dissolved in this solvent. The solids were then separated from the solution containing the heavy ends by filtration.

After separating the chloroform from the heavy ends by distillation, the light ends and heavy ends were combined. If the water solvent had not already been separated from the light ends, then it was separated from the combined light and heavy ends by centrifugation and decantation. The combined light and heavy ends were analyzed for their nickel, vanadium, and sulfur content, carbon-hydrogen atom ration (C/H), and API gravity. The water was analyzed for nickel and vanadium, and the solids were analyzed for nickel, vanadium, and sulfur. X-ray fluoresence was used to determine nickel, vanadium, and sulfur.

Example 2 involves vacuum gas oil. Examples 3–5 involve straight tar sands oil, and Examples 6–7 involve topped tar sands oil. Topped tar sands oil is the straight tar sands oil used in Examples 3–5 but from which approximately 25 weight percent of light material has been removed. Examples 8–10 involve Khafji atmospheric residual oil; Examples 11–12 involve C atmospheric residual oil; and Example 13 involves Cyrus atmospheric residual oil. The compositions of the hydrocarbon feeds employed are shown in Table 1. The experimental conditions used and the results of analyses of the products obtained in these Examples are shown in Tables 2 and 3, respectively. A 300-milliliter Hastelloy alloy B Magne-Dash autoclave was employed as the reaction vessel in Example 2, while a 300-milliliter Hastelloy alloy C Magne-Drive autoclave was employed as the reaction vessel in Examples 3–13.

Comparison of the results shown in Table 3 indicates that desulfurization and demetalation of the hydrocarbon feed occurred and that the hydrocarbon feed was cracked, producing gases, light ends, heavy ends, and solid residue. The extent of removal of sulfur and metals increased when the reaction time was increased from 1 to 3 hours. Beyond that time, the extent of desulfurization decreased with increasing reaction time.

When the water density was at least 0.1 gram per milliliter — for example, when the hydrocarbon fraction-to-water weight ratio was 1:3 — the sulfur which was removed from the hydrocarbon feed appeared as elemental sulfur and not as sulfur dioxide nor as hydrogen sulfide. At lower water densities — for example, when the hydrocarbon fraction-to-water weight ratio was 4:1 or 5.4:1 — part of the removed sulfur appeared as hydrogen sulfide. This clearly indicates a change in the mechanism of desulfurization of organic compounds on contact with a dense-water-containing phase, depending upon the water density of the dense-water-containing phase. Further, when the hydrocarbon-to-water weight ratio was 4:1, there was an adverse shift in the distribution of hydrocarbon products and a lesser extent of desulfurization.

The total yield and compositions of the gas products obtained in several of the Examples are indicated in Table 4. In all cases, the main component of the gas products was argon which was used in the pressurization of the reactor and which is not reported in Table 4. Generally, increasing the reaction time resulted in increased yields of gaseous products.

TABLE 1

| Components | Vacuum Gas Oil | Tar Sands Oils | | Atmospheric Residual Oils | | |
|---|---|---|---|---|---|---|
| | | Straight | Topped | Khafji | C | Cyrus |
| Sulfur[1] | 2.56 | 4.56 | 5.17 | 3.89 | 3.44 | 5.45 |
| Vanadium[2] | — | 182 | 275 | 93 | 25 | 175 |
| Nickel[2] | — | 74 | 104 | 31 | 16 | 59 |
| Carbon[1] | — | 83.72 | 82.39 | 84.47 | 85.04 | 84.25 |
| Hydrogen[1] | — | 10.56 | 9.99 | 10.99 | 11.08 | 10.20 |
| H/C atom ratio | — | 1.514 | 1.455 | 1.56 | 1.56 | 1.45 |
| API gravity[3] | — | 12.2 | 7.1 | 14.8 | 15.4 | 9.8 |
| Liquid fraction[1] boiling up to 650° F. | 15 | 29.4 | 9.7 | 10.6 | 12.0 | 6.9 |

[1]weight percent.
[2]parts per million.
[3]API.

TABLE 2

| Example | Reaction Time (hours) | Reaction Temperature (° F.) | Reaction Pressure[1] | Argon Pressure[1] | Amount of Water (grams) | Hydrocarbon-to-Water Weight Ratio |
|---|---|---|---|---|---|---|
| 2 | 7 | 715 | 2700 | 450 | 20 | 5.4:1 |
| 3 | 6 | 752 | 4400 | 450 | 90 | 1:3 |
| 4 | 3 | 752 | 4350 | 400 | 90 | 1:3 |
| 5 | 1 | 752 | 4350 | 400 | 90 | 1:3 |
| 6 | 1 | 752 | 4300 | 400 | 90 | 1:3 |
| 7 | 3 | 752 | 4300 | 400 | 90 | 1:3 |
| 8 | 6 | 716 | 3600 | 450 | 90 | 1:3 |
| 9 | 6 | 716 | 3600 | 450 | 90 | 1:3 |
| 10 | 6 | 716 | 2500 | 450 | 30 | 4:1 |
| 11 | 6 | 710 | 2600 | 450 | 30 | 4:1 |
| 12 | 6 | 710 | 3600 | 450 | 90 | 1:3 |
| 13 | 2 | 752 | 4400 | 450 | 90 | 1:3 |

[1]pounds per square inch gauge.

TABLE 3

| Example | Product Composition[1] | | | | Percent Removal of[2] | | | H/C Atom Ratio | API Gravity[3] | Weight Balance[4] |
|---|---|---|---|---|---|---|---|---|---|---|
| | Gas | Light Ends | Heavy Ends | Solids | Sulfur | Nickel | Vanadium | | | |
| 2 | 3.0 | 49.0 | 48.0 | 0 | 8 | — | — | — | — | 99.7 |
| 3 | 3.7 | 84.2 | 5.7 | 6.4 | 56 | — | — | — | — | 97.2 |
| 4 | 11.2 | 75.2 | 8.6 | 5.0 | 63 | 95 | 74 | 1.451 | 20.5 | 100.2 |
| 5 | 1.3 | 70.6 | 27.1 | 1.0 | 36 | 69 | 77 | 1.362 | 20.5 | 99.4 |
| 6 | 1.0 | 62.9 | 39.4 | 0.1 | 39 | 42 | 75 | — | — | 99.9 |
| 7 | 5.9 | 67.2 | 20.0 | 6.9 | 49 | 77 | 96 | 1.418 | 12.5 | 99.7 |
| 8 | 3.9 | 88.8[2] | | 0 | — | — | — | — | — | 92.7 |
| 9 | 4.0 | 49.2 | 45.0 | 1.8 | 35 | — | — | — | — | 102.3 |
| 10 | 2.5 | 37.4 | 60.9 | 0.3 | 22 | — | — | — | — | 97.1 |
| 11 | 2.5 | 35.3 | 62.1 | 0.7 | 30 | — | — | — | — | 98.4 |
| 12 | 4.7 | 53.0 | 38.0 | 1.3 | 32 | — | — | — | — | 100.7 |
| 13 | 4.6 | 49.9 | 33.0 | 12.0 | 27 | — | — | — | — | 100.6 |

[1]weight percent of hydrocarbon feed.
[2]These values were obtained from analyses of the combined light and heavy ends.
[3]API.
[4]total weight percent of hydrocarbon and water feeds recovered as product and water.

TABLE 4

| Example | Reaction Time[1] | Composition of the Gas Products[2] | | | Total Weight Percent of Gas |
|---|---|---|---|---|---|
| | | Hydrogen | Carbon Dioxide | Methane | |
| 4 | 3 | 3.3 | 5.2 | 6.9 | 11.2 |
| 5 | 1 | 2.8 | 3.1 | 3.4 | 1.3 |
| 6 | 1 | 1.0 | 3.8 | 8.4 | 1.0 |
| 7 | 3 | 3.0 | 5.6 | 7.5 | 5.9 |

[1]hours.
[2]mole percent of gas.

Examples 14–18 involve semi-continuous flow processing at 752° F. of straight tar sands oil under a variety of conditions. The flow system used in these Examples is shown in FIG. 1. To start a run, ⅛-inch diameter inert, spherical alundum balls were packed through top 19 into a 21.5-inch long, 1-inch outside diameter, and 0.25-inch inside diameter vertical Hastelloy alloy C pipe reactor 16. The alundum balls served merely to provide an inert surface on which metals to be removed from the hydrocarbon feed could deposit. Top 19 was then closed, and a furnace (not shown) was placed around the length of pipe reactor 16. Pipe reactor 16 had a total effective heated volume of about 12 milliliters and the packing material had a total volume of about 6 milliliters, leaving about a 6-milliliter free effective heated space in pipe reactor 16.

All valves, except 53 and 61, were opened, and the flow system was flushed with argon or nitrogen. Then, with valves 4, 5, 29, 37, 46, 53, 61, and 84 closed and with Annin valve 82 set to release gas from the flow system when the desired pressure in the system was exceeded, the flow system was brought up to a pressure in the range of from about 1000 to about 2000 pounds per square inch gauge by argon or nitrogen entering the system through valve 80 and line 79. Then valve 80 was closed. Next, the pressure of the flow system was brought up to the desired reaction pressure by opening valve 53 and pumping water through Haskel pump 50 and line 51 into water tank 54. The water served to further compress the gas in the flow system and thereby to further increase the pressure in the system. If a greater volume of water than the volume of water tank 54 was needed to raise the pressure of the flow system to the desired level, then valve 61 was opened, and additional water was pumped through line 60 and into dump tank 44. When the pressure of the flow system reached the desired pressure, valves 53 and 61 were closed.

A Ruska pump 1 was used to pump the hydrocarbon fraction and water into pipe reactor 16. The Ruska pump 1 contained two 250-milliliter barrels (not shown), with the hydrocarbon fraction being loaded into one barrel and water into the other, at ambient temperature and atmospheric pressure. Pistons (not shown) inside these barrels were manually turned on until the pressure in each barrel equaled the pressure of the flow system. When the pressures in the barrels and in the flow system were equal, check valves 4 and 5 opened to admit hydrocarbon fraction and water from the barrels to flow through lines 2 and 3. At the same time, valve 72 was closed to prevent flow in line 70 between points 12 and 78. Then the hydrocarbon fraction and water streams joined at point 10 at ambient temperature and at the desired pressure, flowed through line 11, and entered the bottom 17 of pipe reactor 16. The reaction mixture flowed through pipe reactor 16 and exited from pipe reactor 16 through side arm 24 at point 20 in the wall of pipe reactor 16. Point 20 was 19 inches from bottom 17.

With solution flowing through pipe reactor 16, the furnace began heating pipe reactor 16. During heat-up of pipe reactor 16 and until steady state conditions were achieved, valves 26 and 34 were closed, and valve 43 was opened to permit the mixture in side arm 24 to flow through line 42 and to enter and be stored in dump tank 44. After steady state conditions were achieved, valve 43 was closed, and valve 34 was opened for the desired period of time to permit the mixture in side arm 24 to flow through line 33 and to enter and be stored in product receiver 35. After collecting a batch of product in product receiver 35 for the desired period of time, valve 34 was closed, and valve 26 was opened to permit the mixture in side arm 24 to flow through line 25 and to enter and be stored in product receiver 27 for another period of time. Then valve 26 was closed.

The material in side arm 24 was a mixture of gaseous and liquid phases. When such mixture entered dump tank 44, product receiver 35, or product receiver 27, the gaseous and liquid phases separated, and the gases exited from dump tank 44, product receiver 35, and product receiver 27 through lines 47, 38, and 30, respectively, and passed through line 70 and Annin valve 82 to a storage vessel (not shown).

When more than two batches of product were to be collected, valve 29 and/or valve 37 was opened to remove product from product receiver 27 and/or 35, respectively, to permit the same product receiver and/or receivers to be used to collect additional batches of product.

At the end of a run — during which the desired number of batches of product were collected — the temperature of pipe reactor 16 was lowered to ambient temperature and the flow system was depressurized by opening valve 84 in line 85 venting to the atmosphere.

The API gravities of the liquid hydrocarbon products collected were measured, and their nickel, vanadium, and iron contents were determined by x-ray fluorescence.

Diaphragm 76 measured the pressure differential across the length of pipe reactor 16. No solution flowed through line 74.

The properties of the straight tar sands oil feed employed in Examples 14–18 are shown in Table 1. The tar sands oil feed contained 300–500 parts per million of iron, and the amount of 300 parts per million was used to determine the percent iron removed in the product. The experimental conditions and characteristics of the product formed in these Examples are presented in Table 5. The liquid hourly space velocity (LHSV) was calculated by dividing the total volumetric flow rate in milliliters per hour, of water and oil feed passing through pipe reactor 16 by the volumetric free space in pipe reactor 16 — that is, 6 milliliters.

The flow process employed in Examples 14–18 could also be modified so as to permit pumping a slurry of oil shale solids, tar sands solids, or coal solids in a water-containing fluid through pipe reactor 16. In such case, the aluminum balls would not be present in pipe reactor 16, and dump tank 44 and product receivers 27 and 35 could be equipped with some device, for example a screen, to separate the spent solids from the recovered hydrocarbon product. Thus, continuous and semi-continuous flow processing could be used in the recovery process itself.

The above examples are presented only by way of illustration, and the invention should not be construed as limited thereto.

TABLE 5

| | Example 14 | Example 15 | Example 16 | Example 17 | Example 18 |
|---|---|---|---|---|---|
| Reaction pressure[1] | 4100 | 4100 | 4100 | 4100 | 4100 |
| LHSV[2] | 1.0 | 2.0 | 2.0 | 2.0 | 2.0 |
| Oil-to-water volumetric flow rate ratio | 1:3 | 1:2 | 1:2 | 1:3 | 1:3 |
| Packing material | alundum | alundum | alundum | alundum | alundum |
| Product collected during period number[3] | 3 | 1 | 2 | 1 + 2 | 3 |
| Product characteristics | | | | | |
| API gravity[4] | 21.0 | 17.8 | 17.3 | 21.0 | 22.9 |
| Percent nickel removed | 95 | 97 | 69 | 64 | 69 |
| Percent vanadium removed | 97 | 59 | 54 | 73 | 59 |
| Percent iron | | | | | |

TABLE 5-continued

| | Example 14 | Example 15 | Example 16 | Example 17 | Example 18 |
|---|---|---|---|---|---|
| removed | 98 | — | — | 99 | 99 |

[1]pounds per square inch gauge.
[2]hours$^{-1}$.
[3]The number indicates the 7–8 hour period after start-up and during which feed flowed through pipe reactor 16.
[4]API.

We claim:

1. A process for recovering upgraded hydrocarbons from tar sands solids, comprising removing, cracking, desulfurizing, and demetalating hydrocarbons from the tar sands solids by contacting the tar sands solids with a water-containing fluid under super-atmospheric pressure, at a temperature in the range of from about 600° F. to about 900° F., in the absence of externally supplied catalyst and hydrogen, wherein sufficient water is present in the water-containing fluid and said pressure is sufficiently high so that the water in the water-containing fluid has a density of at least 0.10 gram per milliliter and serves as an effective solvent for the removed hydrocarbons; and lowering said temperature or pressure or both, to thereby make the water in the water-containing fluid a less effective solvent for the removed hydrocarbons and to thereby form separate phases.

2. The process of claim 1 wherein the density of water in the water-containing fluid is at least 0.15 gram per milliliter.

3. The process of claim 2 wherein the density of water in the water-containing fluid is at least 0.2 gram per milliliter.

4. The process of claim 1 wherein the temperature is at least 705° F.

5. The process of claim 1 wherein the tar sands solids and water-containing fluid are contacted for a period of time in the range of from about 1 minute to about 6 hours.

6. The process of claim 5 wherein the tar sands solids and water-containing fluid are contacted for a period of time in the range of from about 5 minutes to about 3 hours.

7. The process of claim 6 wherein the tar sands solids and water-containing fluid are contacted for a period of time in the range of from about 10 minutes to about 1 hour.

8. The process of claim 1 wherein the weight ratio of tar sands solids-to-water in the water-containing fluid is in the range of from about 3:2 to about 1:10.

9. The process of claim 8 wherein the weight ratio of tar sands solids-to-water in the water-containing fluid is in the range of from about 1:1 to about 1:3.

10. The process of claim 1 wherein the water-containing fluid is substantially water.

11. The process of claim 1 wherein the water-containing fluid is water.

12. The process of claim 1 wherein essentially all the sulfur removed from the recovered hydrocarbons is in the form of elemental sulfur.

* * * * *

UNITED STATES PATENT OFFICE
CERTIFICATE OF CORRECTION

Patent No. 4,005,005 Dated January 25, 1977

Inventor(s) John D. McCollum and Leonard M. Quick

It is certified that error appears in the above-identified patent and that said Letters Patent are hereby corrected as shown below:

Column 4, line 20, "that a given" should be -- that at a given --.

Column 7, line 39, "emuslion," should be -- emulsion, --.

Column 8, line 37, "and, demetalated" should be -- and demetalated --.

Column 10, line 47, "725°F." should be -- 752°F. --.

Column 11, line 7, "condition" should be -- conditions --.

Column 13, TABLE 1, Footnotes, "[3]API" should be -- [3]°API --.

Column 13, TABLE 3, Footnotes, "[3]API" should be -- [3]°API --.

Column 16, Page 41, "aluminum" should be -- alundum --.

Column 17, TABLE 5-continued, Footnotes, "[4]API" should be -- [4]°API --.

Signed and Sealed this

*Eighteenth* Day of *March 1980*

[SEAL]

*Attest:*

SIDNEY A. DIAMOND

*Attesting Officer* *Commissioner of Patents and Trademarks*